US010976013B2

(12) United States Patent
Gielen et al.

(10) Patent No.: US 10,976,013 B2
(45) Date of Patent: Apr. 13, 2021

(54) ELONGATED LIGHTING MODULE AND LIGHTING SYSTEM

(71) Applicant: SIGNIFY HOLDING B.V., Eindhoven (NL)

(72) Inventors: Vincent Stefan David Gielen, Gastel (NL); Vincent Johannes Jacobus Van Montfort, Sittard (NL); Michel Cornelis Josephus Marie Vissenberg, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/607,706

(22) PCT Filed: Apr. 16, 2018

(86) PCT No.: PCT/EP2018/059624

§ 371 (c)(1),
(2) Date: Oct. 23, 2019

(87) PCT Pub. No.: WO2018/197244

PCT Pub. Date: Nov. 1, 2018

(65) Prior Publication Data

US 2020/0141545 A1 May 7, 2020

(30) Foreign Application Priority Data

Apr. 25, 2017 (EP) ..... 17167874

(51) Int. Cl.
*F21S 2/00* (2016.01)
*F21S 8/06* (2006.01)
(Continued)

(52) U.S. Cl.
CPC ..... *F21S 2/005* (2013.01); *F21S 8/06* (2013.01); *F21V 3/02* (2013.01); *F21V 21/005* (2013.01);
(Continued)

(58) Field of Classification Search
None
See application file for complete search history.

(56) References Cited

U.S. PATENT DOCUMENTS 6,186,642 B1 2/2001 Corcorran et al.
7,695,157 B2 * 4/2010 Yaphe ..... F21V 15/013 362/217.1

(Continued)

FOREIGN PATENT DOCUMENTS

DE 202012100270 U1 5/2013
DE 102013209631 A1 11/2013
DE 202015004594 U1 7/2015

*Primary Examiner* — Britt D Hanley
(74) *Attorney, Agent, or Firm* — Daniel J. Piotrowski

(57) ABSTRACT

An elongated, indirect lighting module comprising a plurality of LEDs arranged along a longitudinal axis in a housing provided with a mounting element having an elongated shape in axial direction. The elongated lighting module further comprising suspension elements for suspended connection of the housing to a ceiling. Each suspension element has at a first end a first connector connected to the mounting element, and at a second, opposite end a second connector for connection to the ceiling. The suspension element via its first connector is displaceable along the longitudinal axis over the mounting element, and the LEDs are configured to issue light into a radial direction essentially away from both the mounting element and the suspension element and for a major part toward the ceiling.

15 Claims, 7 Drawing Sheets

(51) Int. Cl.

| | |
|---|---|
| ***F21V 3/02*** | (2006.01) |
| ***F21V 21/005*** | (2006.01) |
| ***F21V 21/112*** | (2006.01) |
| ***F21V 21/22*** | (2006.01) |
| ***F21V 23/06*** | (2006.01) |
| ***F21Y 103/10*** | (2016.01) |
| ***F21Y 115/10*** | (2016.01) |

(52) U.S. Cl.
CPC ..... *F21V 21/112* (2013.01); *F21V 21/22* (2013.01); *F21V 23/06* (2013.01); *F21Y 2103/10* (2016.08); *F21Y 2115/10* (2016.08)

(56) References Cited

U.S. PATENT DOCUMENTS 7,731,397 B2 * 6/2010 Thomas ..... F21V 15/01 362/404
9,673,582 B2 * 6/2017 Guilmette ..... F21V 21/34
9,822,940 B2 * 11/2017 Bergman ..... F21V 29/70
9,951,913 B2 * 4/2018 Skergeth ..... F21V 19/004
2002/0001191 A1 * 1/2002 Grierson ..... F21V 21/005 362/219
2002/0036906 A1 * 3/2002 Gomez del Campo ..... F21V 21/005 362/391
2010/0254146 A1 * 10/2010 McCanless ..... F21V 21/088 362/368
2013/0279180 A1 * 10/2013 Pearson ..... F21V 15/015 362/371
2014/0126193 A1 * 5/2014 Dixon ..... F21V 7/0016 362/217.02
2015/0338053 A1 * 11/2015 Rector ..... F21V 5/02 362/224
2018/0128450 A1 * 5/2018 Kaminski ..... F21V 17/164
2019/0179070 A1 * 6/2019 Vasylyev ..... G02B 6/0046
2019/0309932 A1 * 10/2019 Evans ..... F21V 21/048
2020/0217467 A1 * 7/2020 Lu ..... F21V 21/005

* cited by examiner

ELONGATED LIGHTING MODULE AND LIGHTING SYSTEM

CROSS-REFERENCE TO PRIOR APPLICATIONS

This application is the U.S. National Phase application under 35 U.S.C. § 371 of International Application No. PCT/EP2018/059624, filed on Apr. 16, 2018, which claims the benefit of European Patent Application No. 17167874.1, filed on Apr. 25, 2017. These applications are hereby incorporated by reference herein.

BACKGROUND OF THE INVENTION

The invention relates to an elongated lighting module for providing general and/or ambient lighting, typically this attained in a convenient manner by an elongated, indirect lighting module. The invention further relates to a (n indirect) lighting system comprising at least two end-to-end coupled elongated lighting modules. A lighting module or lighting system having the features of an indirect lighting module/system provides essentially only indirect lighting and the issue of direct light is very limited, i.e. for example less than 10% of the total issued light. In a suspended indirect lighting module or system, light is not issued from the module/system directly downwards, i.e. in the direction of gravity, but essentially light is only provided to the ambient in a downward direction after first being directed upwardly towards a (false) ceiling and subsequently reflected therefrom in a downward direction. In analogy, the same applies for an indirect lighting module/system mounted in front of a (vertical) wall.

Linear general/ambient lighting systems are used in a wide variety of building construction applications. The linear lights or fixtures typically include a cover for shielding direct lighting, an elongated lighting element, and some kind of supporting structure for suspending the lighting system above the floor of an associated building. Linear lighting systems have normally incorporated multiple separate lighting units or fixtures that are positioned end-to-end to form a single elongate linear light. These lighting units are usually suspended from the ceiling and may be fastened and optionally also electrically connected together end-to-end, typically following the grid formed by the supporting T-bars of a false ceiling. An example of a suspended linear ambient lighting system is disclosed in US6186642B1. The known linear ambient lighting system comprises fluorescent type lighting elements that suspend from a ceiling and which as explicitly indicated in the disclosure provide indirect lighting when at least a significant portion of light emitted from each lighting element is first issued in an downward direction to a reflector built-in inside the cover, then reflected upward by said built-in reflector through a window in the cover to the ceiling, and subsequently (diffusely) reflected by the ceiling in an downward direction as ambient lighting. However, the known linear ambient lighting system and its lighting elements have the disadvantage of being of a relatively expensive, complex and bulky construction, and the further disadvantages that said construction renders the lighting system to have a relatively low efficacy and that it provides lighting that is experienced as relatively unpleasant.

SUMMARY OF THE INVENTION

It is an object of the invention to provide an elongated lighting module, for example an elongated indirect lighting module, of the type as described in the opening paragraph in which at least one of the disadvantages is obviated or counteracted. Thereto the invention relates to an elongated lighting module defining a longitudinal axis and comprising:

- a housing having a base at a base side and a light transmissive cover comprising a light transmissive cover top at a top side opposite said base side and a light transmissive wall extending between the top side and the base side,
- an array of LEDs accommodated in a space enclosed by the base and the cover and facing away from the base side,
- a mounting element for suspended connection via a suspension element to a ceiling defining in suspended arrangement a suspension axis, the mounting element extending over essentially the full length of the module, centrally intersecting or extending on the cover top and enabling the suspension element to be displaceable along the longitudinal axis. Centrally in this context means that in a suspended arrangement of the lighting module said lighting module is tilted less than 10 degrees, i.e. the suspension axis extends transverse to the base, or in other words the base is within 10 degrees of a horizontal orientation.

The lighting module further could have the feature that the suspension element comprises:

- at a first end a first connector connected at the top side to the mounting element, and
- at a second, opposite end a second connector for connection to a ceiling, in a suspended arrangement the suspension axis is defined by the direction between the first and the second connector. Contrary to what is the case in the known lighting system, light is not issued first in a downward direction away from the ceiling, and then reflected to illuminate the ceiling, instead by the inventive lighting module light is for a major part directly issued by the LEDs toward the ceiling, major in this respect means at least 50% of the light, but preferably at least 70%, or at least 90%. As each reflection involves some loss of light, the elongated lighting module of the invention in principle can have a higher efficacy than the efficacy attained by the lighting elements of the known lighting system. In the inventive lighting module it is further avoided that light from the LEDs issued directly toward the ceiling is essentially directed away from both the mounting element and the suspension element to counteract light loss due to absorption of light by said both elements. This can be attained, for example, by considering the combination of the light beam characteristics as issued by the LEDs and the orientation/tilt of the LEDs with respect to the ceiling, the mounting element and the suspension element. Typical beam characteristics in this respect are beam angle, beam axis and beam pattern, typical orientation features of the LEDs are the angled position of its beam axis with respect to the ceiling, and the plane defined by the length axis and the suspension axis. Thereto the elongated lighting module may have the feature that the plurality of LEDS are mounted on the mounting element, preferably at an angle $\beta$ with the suspension axis toward the ceiling, wherein $0° <= \beta <= 90°$.

The relatively unpleasant lighting as provided by the known lighting system is caused by the bulky, reflective cover. Said cover is used to capture and reflect light originating from the wide beam emitting light sources to the ceiling, but that at the same time causes sharp light-dark contrasts between the bright illuminated ceiling and the bulky, dark cover of the lighting system. Particularly, in principal fluorescent lamps emit light essentially over 360°, however specific features may be provided to the fluorescent lamp to narrow the beam and give it a preferred direction, which seems to be the case in the know lighting system disclosed in US6186642B1 because of its explicit statement of light first being issued in an downward direction to a reflector built-in inside the cover, then reflected upward by said built-in reflector through a window in the cover to the ceiling. Yet, in the present invention, by the combination of features in the elongated lighting module, in particular the suspension element extending connected at the top side from the mounting element, said mounting element extending essentially over the whole length of the transparent cover, also referred to as optical element, which is mounted over the LEDs and using relatively small LEDs as light sources, not only the angle of the wide beam emission is reduced, i.e. in the case of Lambertian emitting LEDs the beam angle is about 120°, but it is additionally enabled that the elongated lighting module can be very slim compared to the known lighting system.

Typically, in suspended arrangement the light transmissive cover top faces towards the ceiling and is seamlessly in a curved manner is connected to the light transmissive walls of the cover. The light transmissive walls could extend parallel to the suspension axis. Hence, all these features results in that disturbing dark areas caused by the lighting module being suspended in front of the bright ceiling, are significantly reduced, and optionally even can be virtually eliminated (i.e. insignificant to the human eye) by a carefully chosen, for example tilted, over for example 20°, orientation of the LEDs with respect to suspension axis. The transparent cover extending essentially over the full length has two effects, firstly the cover extending over the whole length without interrupting openings counteracts the collection of contamination (for example dust, insects) inside the lighting module, and secondly the ceiling above the lighting module is illuminated in a more continuous and uniform manner, i.e. illumination is done without interrupting shadows which else would be caused by non-transparent sections.

Typically the elongated lighting module could be an indirect lighting module for providing essentially glare-free, general and/or ambient lighting.

The elongated lighting module could have various features, such as that the light transmissive side walls extending from the cover top to the base directly contact the base, for example in that the transparent cover is directly connected to the base via said side walls. Furthermore, the inner space can be divided, for example by the mounting element, into more, for example two parallel extending, inner spaces. The mounting element extending centrally over the whole length of the transparent cover enables the suspension element via its first connector to be displaceable over said mounting element.

The elongated lighting module could have the feature of the base having a base surface defining a plane B, the lighting device in operation issuing only light towards the cover or upward, which is issued from the lighting device in an area between said plane B and the outer cover top surface. Upward in this context means that in suspended arrangement of the lighting module, light is issued essentially in a direction against gravity, for example only to the ceiling, from which the lighting module is suspended. Thus essentially only indirect is generated to provide desired ambient light, and the risk on glare is counteracted effectively.

The elongated lighting module could have the feature that at least one of the base, the suspension element and the mounting element is reflective, preferably diffuse reflective. Thus it is counteracted that diffusely reflected light, for example at the ceiling, which is reflected back to the light module is lost and hence an increased efficacy of the lighting module is attained.

The elongated lighting module could have the feature that the cover is divided by the mounting element into two elongated cover parts axially extending mutually parallel and next to each other. The inner space formed by the cover and the base, then could also be divided into two elongated parallel extending inner space parts. each inner space could then accommodate a respective array of LEDs, for example a respective LED strip which optionally can be individually addressed and operated. Thus a lighting module is attained which is more versatile in modes of operation.

The elongated lighting module could have various additional and/or alternative features and/or be provided in various embodiments. For example, the elongated lighting module could be an elongated indirect lighting module extending along a longitudinal axis and comprising:

- a housing accommodating a plurality of LEDs arranged along the longitudinal axis and being provided with a mounting element extending in axial direction over essentially the whole length of the housing;
- a transparent cover mounted over the LEDs and extending in axial direction over essentially the whole length of the housing; and
- at least one suspension element for suspended connection of the housing to a ceiling and comprising at a first end a first connector connected to the mounting element, and at a second, opposite end a second connector for connection to the ceiling, in a suspended arrangement the first and second connector define a suspension axis, the suspension element via its first connector is displaceable along the longitudinal axis over the mounting element, the LEDs are configured to issue light through said cover into a radial direction essentially away from both the mounting element and the suspension element and for a major part toward the ceiling, and at least one of the mounting element and the suspension element extends through and/or from the transparent cover.

The lighting module could have the feature that at least one of the mounting element and the suspension element extends through and/or from the transparent cover.

The lighting module could have the feature that at least one of the mounting element and the suspension element is directly connected to the transparent cover.

The lighting module could have the feature that the mounting element has a width Mw which is less than a half the cross-sectional width Mc of the cover or less than half the combined/added cross-sectional widths of cover parts.

The lighting module could have the feature that viewed in cross section transverse to the longitudinal axis there is only one mounting element and the suspension axis extends through the heart line of the cover The lighting module could have the feature that the mounting element is fixed to the housing at least partially via the transparent cover The lighting module could have the feature that the transparent cover has an opening only facing towards the suspension element, said opening extends within an angle range with the suspension axis from 0 to 90°

The lighting module could have the feature that the housing only having a light exit window facing towards the suspension element, said exit window is provided with said cover and extends only within an angle range with the suspension axis from 0 to 90°

The lighting module could have the feature that the transparent cover facing towards the suspension element and extending over essentially the whole width of the housing and portions of side walls of the housing. Furthermore, the inventive elongated lighting module is particularly suited for accommodating elongated LED strips as a light source. Typically elongated LED strips have cross-sectional dimensions in the order of 8 mm to 18 mm width Ws (i.e. transverse to the main issue direction of the light beam as issued by the LEDs, i.e. the issue direction of light of the highest intensity as emitted by the LEDs) and the order of 2 mm to 8 mm height Hs (i.e. alongside the main issue direction of the light beam as issued by the LEDs). Typically, the elongated lighting module has a width W which is in the range of 1.2 to 4 times the width Ws of the LED strip, i.e. W is in the order of 10 mm to 70 mm width, and a height H of the elongated lighting module (excluding the suspension element) in the order of 3 to 6 times the height Hs of the strip, i.e. H is in the order of 5 mm to 45 mm. The elongated lighting module might have the feature that, when the plurality of LEDs comprises two LED strips which extend mutually parallel along the longitudinal axis, the LED strips are mutually spaced apart by at the most the width of a single LED strip, i.e. the width W is at the most 3 times the width Ws of a single LED strip. For example, an elongated lighting module having as a light source a single LED strip having their main issue direction toward the ceiling, the elongated lighting module has a width W of about 1.5 times the width Ws of the LED strip because the optic element over the LED strip which is somewhat broader than the LED strip itself, i.e. in the range of about 12 mm to 36 mm. For example, an elongated lighting module having as a light source two parallel arranged LED strips having their main issue directions parallel to the ceiling, the elongated lighting module has a width W of about two times the width Ws (each optics over the LED strip has a dimension of about the width of the LED strip) plus about two times the height Hs of the LED strips, i.e. the LED strip has width Win the range of about 16 mm to 36 mm plus 4 mm to 16 mm, i.e. in the range of 20 mm to 52 mm. Typically these dimensions of the elongated lighting module of the invention are much smaller than the dimensions of the (cover of the) known lighting system. The order of magnitude of the known lighting system is about 6.5 times the diameter of the fluorescent tube, i.e. about 6.5*18 mm is about 110-120 mm, see FIG. 6 of US6186642B1. These small dimensions of the elongated lighting module render it to be relatively unobtrusive and to have an acceptably low light-dark contrasts between the bright illuminated ceiling and the non-illuminated elongated lighting module being suspended in front of said ceiling.

Typically in the known lighting system the lighting elements are arranged in an aligned orientation with the T-bar grid of the (false) ceiling, i.e. the lighting elements extend alongside the T-bars which is likely due to limited position possibilities of the lighting elements. A free positioning of the elongated lighting module is advantageous as it gives more design freedom and better tuning possibilities for desired lighting settings. Thereto the elongated lighting module may have the feature that the first connector is continuously displaceable along the longitudinal axis over the mounting element, thereto the mounting element preferably is a rail-like structure, in particular when combined with the optional feature that least one of the first connector and second is rotatably connected over the suspension axis to the mounting element. Alternatively, the first connector is displaceable in, preferably relatively small, distinct steps, for example in steps of 5 mm up to steps of 50 mm or even 200 mm, along the longitudinal axis over the mounting element. Thereto the mounting element may have a vertically and/or horizontally extending wall comprising small cavities or through holes in which the first connector can be inserted.

The elongated lighting module may have the feature that in suspended arrangement the LEDs are equidistant or closer to the ceiling than the mounting element. Thus the risk of shadowing of the mounting element on the ceiling being present is reduced. Such shadow could be caused by the mounting element that can block light issued from the LEDs towards the ceiling in case it extends closer to the ceiling than the LEDs, i.e. is (at least partly) located in between the LEDs and the ceiling. This shadowing could be alternatively or additionally be counteracted by making the mounting element light transmissive, for example by manufacturing it from light transmissive material, for example from Poly-Methyl-Methacrylate (PMMA), PolyCarbonate (PC) or PolyEthylene (PE). In particular light transmissive mounting elements and suspension elements are favorable when the suspension element with its first connector grips around the elongated lighting module, i.e. when the suspension element crosses with the light beams issued by the LEDs.

The elongated lighting module may have the feature that the suspension element is adjustable in length. Typically, when the elongated lighting module is applied as a suspended luminaire from false ceilings variation in height of the ceiling might be present. It is thus enabled that the suspension of the elongated lighting module can compensate for irregularities that result in variation in the mounted height of the false ceiling thus not to pass on said variation in height to the mounting height of the elongated lighting modules. Furthermore, with a suspension element that is adjustable in length the elongated lighting module can be suspended at the desired distance from the ceiling.

The elongated lighting module may have the feature that in a direction transverse to the longitudinal axis the mounting element has a U-shaped, T-shaped, Y-shaped, or cross-shaped cross section. Typically those cross sectional shapes provide a hook-like feature to the first connector. Said hook-like feature is either at the outer side of the mounting element when the first connector grips around the mounting element, for example in the case of T-, U-, V-, Y-, I-, +-cross section, or similarly shaped cross-sections, or said hook-like feature is at the inner side of the mounting element, for example in the case of U-, V- or (upside-down) Y-shaped cross sections.

The elongated lighting module may have the feature that the second connector is configured as a clamp for gripping around a T-Bar profile. Thus a relatively simple manner of mounting the elongated lighting module to a (false) ceiling is enabled without the necessity of using tools.

The elongated lighting module may have the feature that the suspension element comprises a cord, tube or a rod interconnecting the first connector and the second connector. In case the suspension element comprises a cord, torsion over the length of a single or a plurality of mounted elongated lighting modules is counteracted due to the flexibility of the suspension cord. Furthermore, the use of thin cords as suspension element reduces the risk on disturbing shadowing caused by the suspension element. When the suspension element is a tube or rod, especially when all the rods used for suspension of the elongated lighting module have the same length, mounting of the elongated lighting module at the preset, desired height is relatively simple and height adjustment is not necessary. The tube has the additional advantage that electrical wiring can unobtrusively extend through the suspension element from the ceiling to the elongated lighting module.

There are various configurations via which the connection between the mounting element and the first connector can be realized, i.e.

- the elongated lighting module may have the feature that the mounting element grips around the first connector;
- the elongated lighting module may have the feature that the first connector grips around the mounting element; and
- the elongated lighting module may have the feature that the first connector is in hooked configuration with the mounting element.

Depending on the situation and the desired lighting distribution the appropriate configuration can be chosen. For example, if not only a part of the ceiling on either side of the elongated lighting module but also a part of the ceiling directly above the suspended elongated lighting module is to be illuminated, not only the position of the mounting module with respect to the LEDs must be such that it does not block light from the LEDS that is directed to the ceiling to avoid shadowing, but additionally that the dimension of the support structure, and hence first connector preferably is as small as possible to avoid shadowing thereof as well. In such a case it is preferred that the suspension element is a cord which can extend to in between or even to below the LEDs towards the mounting element, and the LEDs are mounted such that they (at least partly) rest on the mounting element. The first connector of the suspension element then preferably is so small that it can pass in between the LEDs to be connected to the mounting element. Because the first connector is so small it is favorable that the mounting element grips around the first connector. However, if only a part of the ceiling on either side of the elongated lighting module is to be illuminated, the suspension element and its first connector might be larger and hence the first connector can be so large that it either grips around the mounting element or is in a hooked configuration therewith.

The elongated lighting module may have the feature that the mounting element comprises electrical contact for electrical connection to the suspension element comprising an electric cable. Thus an unobtrusive electrical connection of the elongated lighting module to (mains) power supply is obtained and the mounting and the electrical connection of the elongated lighting module occurs simultaneously.

The elongated lighting module may have the feature that electric control components are accommodated in the housing in a compartment located below the plurality of LEDs. Thus a compact elongated lighting module is obtained which holds all equipment for operation, and only needs to be electrically connected to mains, i.e. driver equipment needs not to be installed on the ceiling, thus simplifying installation of the elongated lighting modules.

The invention further relates to a lighting system comprising at least two mutually end-to-end coupled elongated lighting modules according to the invention lying in line with each other. Typically the number of end-to-end coupled elongated lighting modules that are in extension with each other may vary from a small number, for example two, three, or four, to a relatively large number, for example ten, twenty or even up to hundred. The typical length of a single elongated lighting module could be in the range of 30 cm to 360 cm, for example 60 cm or 120 cm. The end-to-end couple elongated lighting modules may have the feature that they are mutually both mechanically and electrically coupled. Such a way of end-to-end coupling enables i) simple physical substitution of a single elongated lighting module from a line of coupled elongated lighting modules in a direction transverse to said line and without the need for shifting/displacing adjacent elongated lighting modules in a direction along the line, and enables ii) a simple electrical connection and electrically driving/operating the elongated lighting modules with a single connector and/or driver for a plurality of elongated lighting modules.

The lighting system may have the feature that the elongated lighting modules are end-to-end coupled via a connection module, either inserted in between two adjacent elongated lighting modules or mounted on side surfaces, i.e. not the surfaces of adjacent elongated lighting modules that are facing each other, of abutting end portions of the adjacent elongated lighting modules. Such a connection module may have the feature that it comprises a sensor, for example a (day)light sensor, an occupation sensor, and IR-sensor, an alarming device, for example a sound horn, a flashlight, a sprinkler head, and/or it may have the feature that it comprises an additional light source, for example an additional LED providing direct illumination, for example emergency or spotlight illumination. The connection module may have the feature that it comprises on opposite ends respective end faces that are in mutually angled position in the plane P perpendicular to the suspension axis and/or parallel to the supporting structure. Connection between two adjacent elongated lighting modules is done via said end faces and then results in the elongated lighting modules to be oriented in a mutually angled position, for example at a mutual angle of 30°, 45° or 90° in said plane P. Thus even more freedom of positioning of the elongated lighting modules with respect to the ceiling grid structure is enabled.

BRIEF DESCRIPTION OF THE DRAWINGS

These and other features, advantages, and objects of the present invention will be further understood and appreciated by those skilled in the art by reference to the following schematic drawing, in which.

DETAILED DESCRIPTION OF THE INVENTION

Figure 1A:
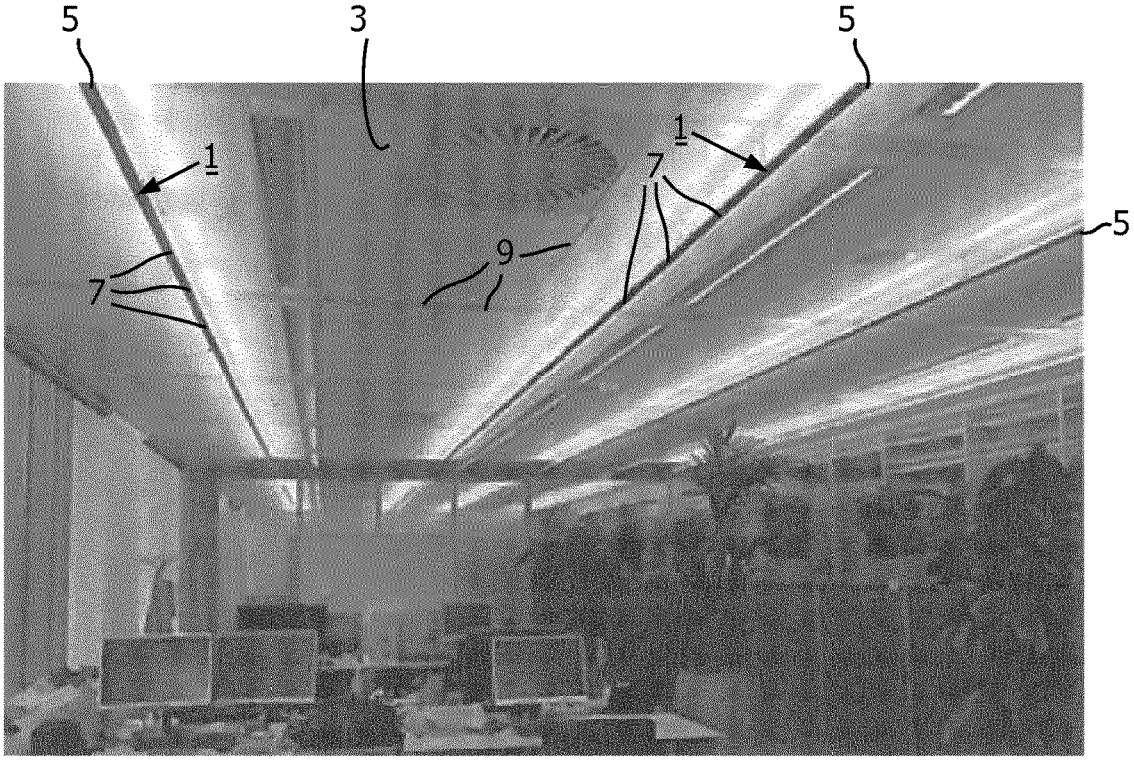
FIG. 1A shows a lighting system according to the invention installed on a ceiling at a test location.

FIG. 1A shows a lighting system 1 according to the invention installed at a ceiling 3 of an office at a test location, in the figure an indirect lighting system. The lighting system comprises a plurality of parallel extending rows 5 of a plurality of end-to-end coupled elongated, indirect lighting modules 7. As shown the ceiling has grid structure 9 from which the rows of elongated lighting modules are suspended, said rows extend parallel to the grid structure. The lighting system issues light toward the ceiling which diffusely reflects said light and thus provides indirect, ambient light in the office. A comfortable illumination is attained in which glare is essentially absent as a direct view of light sources is counteracted by the configuration of the lighting system.

Figure 1B:
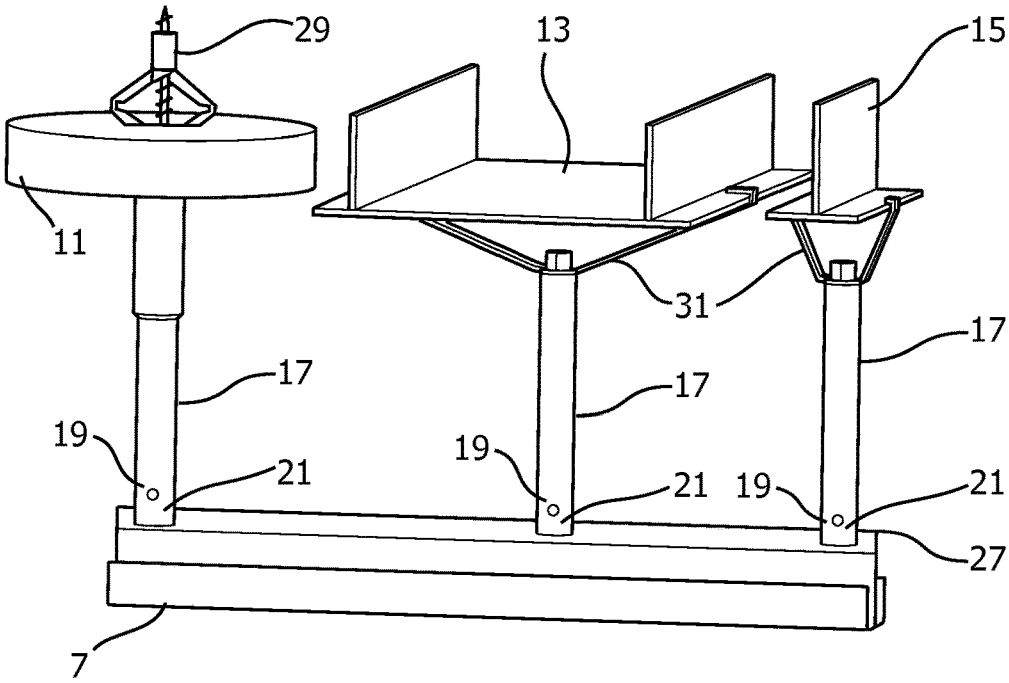
FIG. 1B shows various types of ceiling structures to be connected to by a second connector.

FIG. 1B shows various types of ceiling structures to which an elongated lighting module 7 is mounted. The ceiling structure can, for example, be a ceiling tile 11, a double T-bar 13 or a single T-bar 15 ceiling grid element. The elongated lighting module comprises a suspension element 17 with at a first end 19 a first connector 21 and at an opposite, second end 23 of the suspension element a second connector 25. The first connector is connected to a mounting element 27 of the elongated lighting module and the second connector is connected to the ceiling structure and, as the examples show in the figure, embodied as a screw/plug 29 connected to the ceiling tile or as a clamp 31 clamping around the (double) T-bar grid element.

Figure 2:
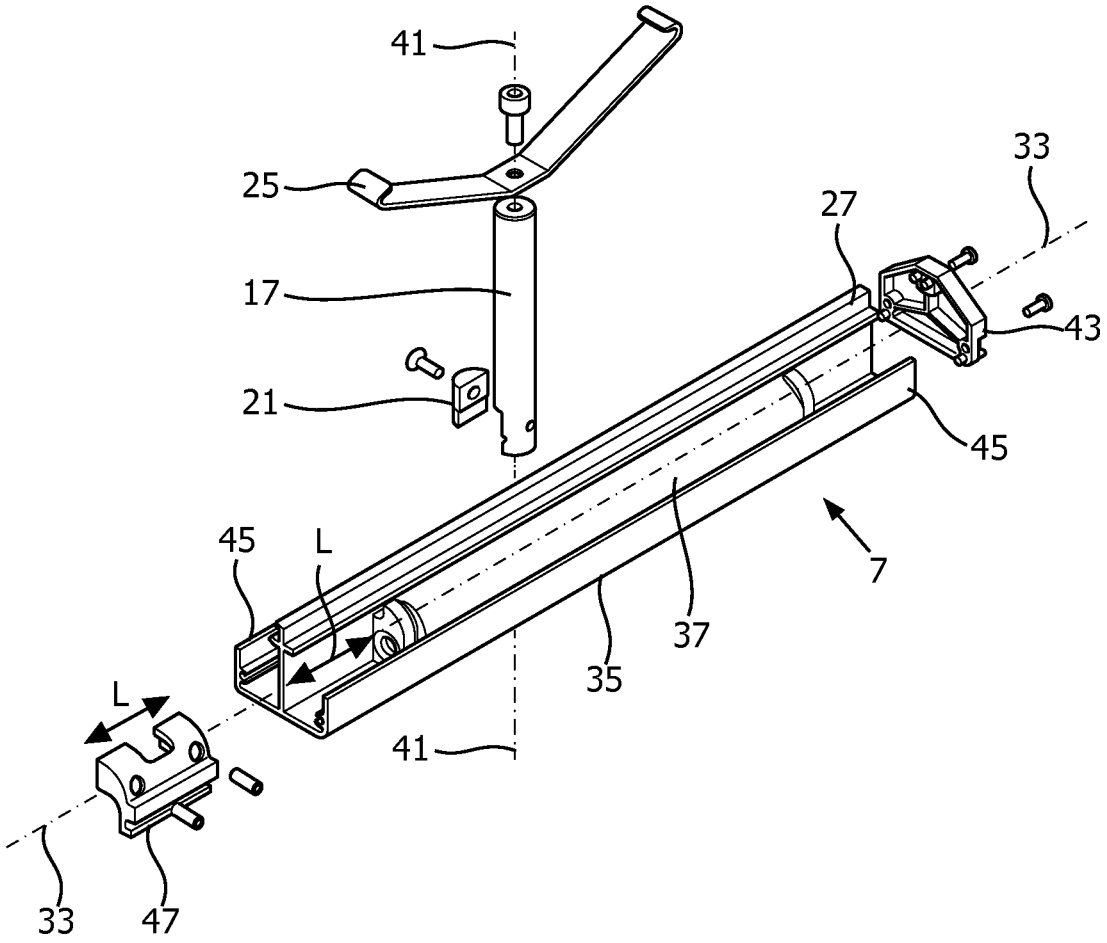
FIG. 2 shows an exploded view of an elongated lighting module according to the invention.

FIG. 2 shows an exploded view of an elongated lighting module 7 according to the invention. The elongated lighting module extends along a longitudinal axis 33 and comprises a housing 35 provided with a mounting element 27 having a cross-shape in cross section. In the housing a light source, in the figure two parallel rows 49 of a plurality of LEDs 37, is arranged along the longitudinal axis, with as an optical element 39 a cover provided over the LEDs. A suspension element 17, in the figure embodied as a rod, has a first connector 21 for connection to the mounting element, and has a second connector 25, in the figure a clamp, for connection to a T-bar of the ceiling grid (not shown). In installed, suspended configuration of the elongated lighting module, the first and second connector define a suspension axis 41. The first connector is continuously displaceable along the longitudinal axis over the mounting element, the second connector is continuously displaceable over the T-bar. The elongated lighting module further comprises an end cap 43 for closing the housing at a housing end 45 of elongated lighting module and, in the embodiment shown in the figure, has a couple element 47 for end-to-end coupling along the elongated axis with an end 45 of the elongated lighting module to an end of and adjacent elongated lighting module (not shown). The couple element has a length L in longitudinal direction and the housing has a cavity with length L (for the sake of clarity shown in over-sized form in the figure) in longitudinal direction, such that when an elongated lighting module sandwiched between two adjacent end-to-end coupled elongated lighting modules has to be dismounted, the coupling element can be completely moved and accommodated into the adjacent elongated lighting module, thus de-coupling the adjacent elongated lighting modules. Thus the sandwiched elongated lighting module can easily be removed and replaced. As shown in the figure, in a direction along the suspension axis, the mounting element is located in between the light source (LEDs) and the ceiling. Due to the small-sized LEDs both the housing and the mounting element can be so thin that unpleasant shadowing and/or contrasting bright-dark areas between ceiling and elongated lighting module are avoided.

Figure 3A:
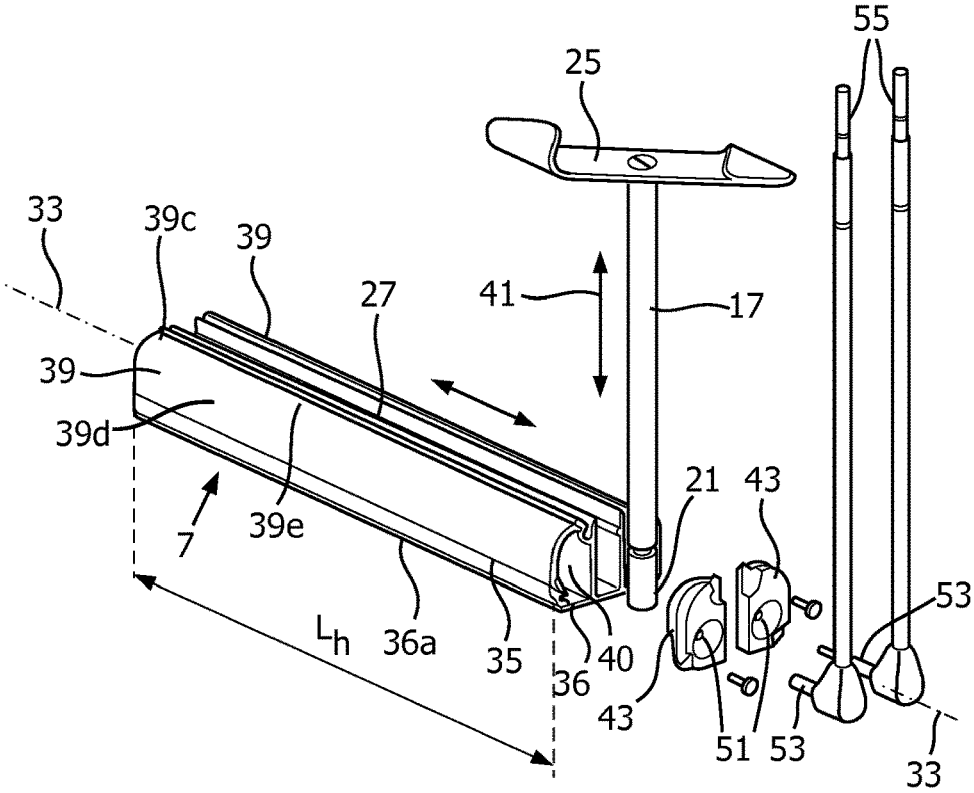
FIG. 3A shows a perspective view of another embodiment of an elongated lighting module according to the invention.

FIG. 3A shows a perspective view of another embodiment of an elongated lighting module 7 according to the invention. The elongated lighting module comprises housing 35 accommodating a light source, in the figure two parallel rows 49 of a plurality of LEDs (see FIG. 3B), is arranged along the longitudinal axis 33, each row with as an optical element 39 a respective transparent, optionally optical active, cover provided over the LEDs. In the figure the cover comprises two cover parts 39*a*,39*b* each with a respective light transmissive top cover 39*c* at a top side 39*e* and a light transmissive side wall 39*d* contacting base 36 at a base side 36*a*. A shown, the cover and the base have the same width in cross section. The elongated lighting module further comprises a mounting element 27, having a U-shaped cross-section and which extends over the full length Lh of the housing through the cover top, by which said cover is divided into said two cover parts 39*a*,39*b*. Each cover part in combination with the base and with the mounting element enclosing a respective inner space part 40*a*,40*b* of inner space 40 (see also FIG. 3B). Said mounting element is located in between the two rows 49 of plurality of LEDs and in the suspension direction 41 is located at about the same height as the LEDs, thus not blocking light issued by the LEDs towards the ceiling. The rodded suspension element 17 is adjustable in length along the suspension direction (see FIG. 3B) and has its first connector 21 accommodated in the U-shape of the mounting element and is slideable in longitudinal direction in the mounting element. The second connector 25 of the suspension element comprises a clamp which is rotatable over the suspension axis 41 enabling it to fit with T-bars of various sizes. An end cap 43 in two parts is provided, having respective electrical contacts 51 for connection with associated electrical plugs 53 and cables 55 extending from the ceiling for electrical connection of LEDs to mains power supply.

Figure 3B:
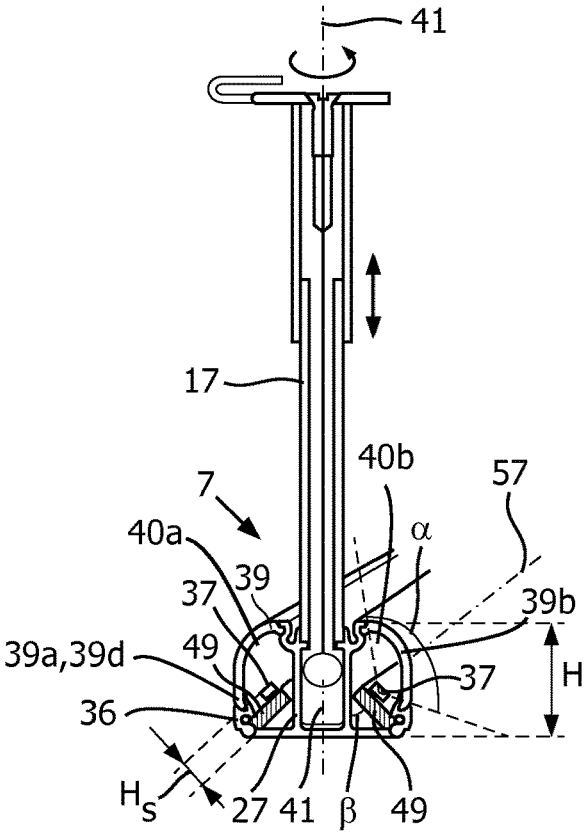
FIG. 3B-F show perspective cross-sections of various suspension elements of an elongated lighting module according to the invention.
Figures 3C, 3D, 3E, 3F:
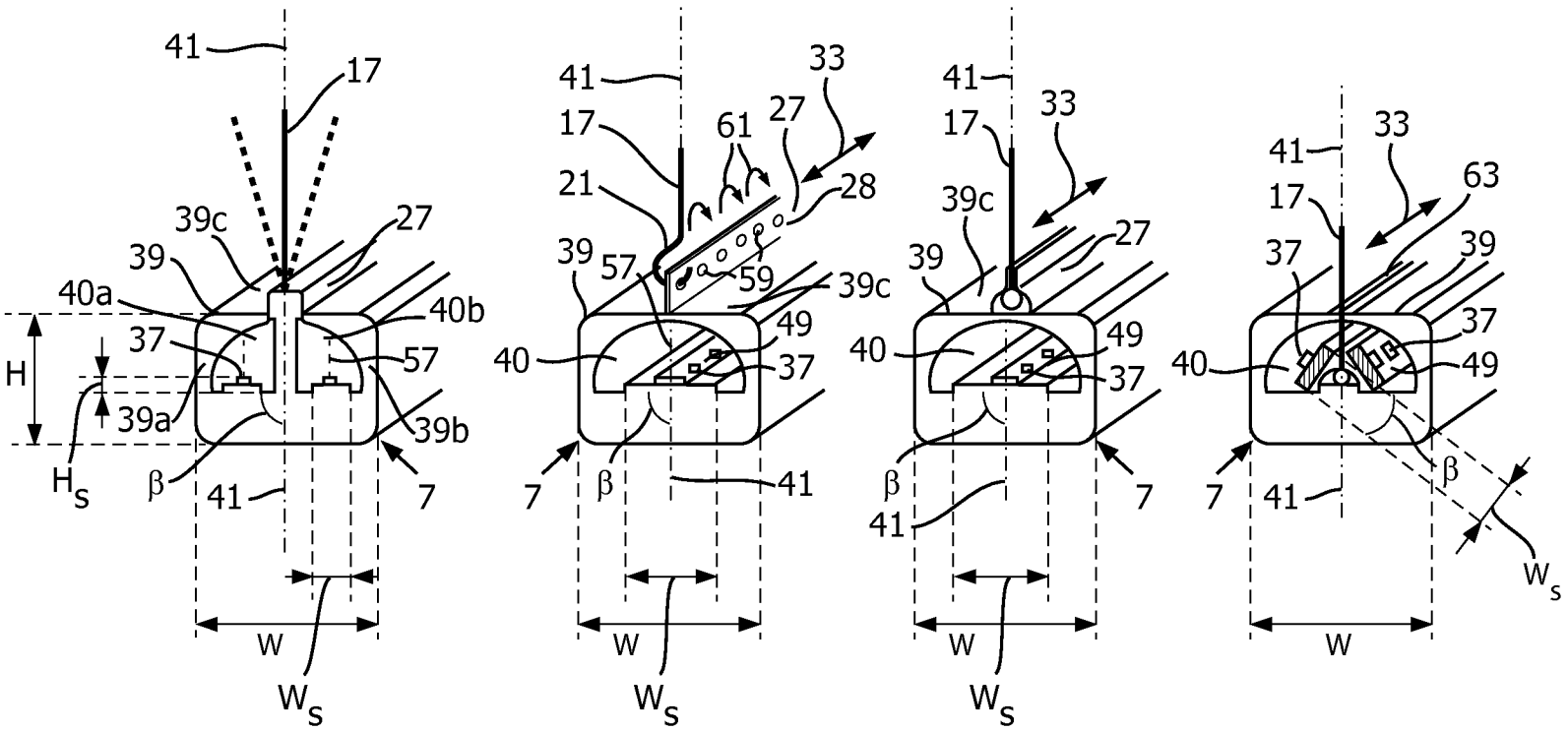

FIG. 3B-F show perspective cross-sections of various suspension elements of an elongated lighting module 7 according to the invention. FIG. 3B shows a perspective cross-section of the elongated lighting module of FIG. 3A with the elongated lighting module 7 and the rod-shaped suspension element 17 in connected position and extending through the optical element 39, i.e. a transparent cover. As shown, the mounting element 27 extends through the optical element 39 and divides the cover into two cover parts 39*a*, 39*b* extending mutual parallel in axial direction. Further, said mounting element 27 is located in between two rows 49 of plurality of LEDs 37 with the first connector 21 of the suspension element inserted in the cavity of the U-shaped mounting element. Said rows are LED strips which abut against the mounting element and are tilted at an angle β of about 40° with the suspension axis 41 and the LEDs issue light beams with a beam angle α of about 120° and having beam axis 57 that point toward the ceiling. FIGS. 3C-F show elongated lighting modules 7 with various embodiments of cord-shaped suspension elements 17 in combination with various embodiments of mounting elements 27. In FIG. 3C the functional flexibility of the cord-shaped suspension 17 element is shown, for example, the flexibility of the cord could be used for handling torsion phenomena. The mounting element 27 divides both the inner space and the cover into two parts, respectively 40*a*,40*b* and 39*a*,39*b*. As both the suspension element and mounting element 27 can be relatively thin and extend through the cover top 39*c* of optical element 39 and through inner space 40, the LEDs 37 can be oriented with their beam axis 57 pointing upward to the ceiling and parallel to the suspension axis 41 (in other words β=90°) without the risk on disturbing shadow/contrast effects, as shown in FIGS. 3C-E. FIG. 3D-E show a single row of LEDs 49 with only one cover (optionally embodied as optical active element 39). FIG. 3D shows the first connector 21 of the suspension element 17 embodied as a hook which is in hooked configuration with a vertically extending wall 28 of mounting element 27 extending from the cover top 39*a* of optical element 39, which thereto is provided with through holes 59. Alternatively the perforated wall 28 can extend horizontally. The suspension element is discontinuously displaceable in distinct, small steps 61 over the mounting element along the longitudinal axis 33 by stepping from through hole to through hole, typically the distinct steps are in the range of 10 mm to 100 mm. Typically in FIGS. 3D and 3E the mounting element 27 is extending over an outer surface of the cover top 39*c*, the mounting element does neither divide the cover 39 nor the inner space 40 into two parts. FIG. 3E-F shows the first connector 21 of the suspension element 17 embodied respectively as a ball on a cord and an upside-down Y-shape with the ball inserted in the cavity of the upside-down Y. In FIG. 3E the mounting element in the suspension direction 41 is located above the plurality of LEDs 37, while in FIG. 3F the mounting element in the suspension direction is located below the plurality of LEDs. In FIG. 3F the cover 39 is provided with a slit 63 through which the suspension element 17 extends and divides the cover into two parts that are mutually connected via a pair of bridges (not shown), yet without the inner space 40 being divided into two inner space parts. The cord-shaped suspension element 17 can move through the slit and over the mounting element 27, which thus more or less functions as a rail, along the longitudinal axis 33 essentially over the whole length of mounting element of the elongated lighting module 7, except for the pair of bridges. In the FIGS. 3B-F it is shown that the light source is a LED strip with a width Ws and a height Hs. In FIGS. 3B and 3F, the width W of the elongated lighting module is about three times the width Ws of the LED strip and the LED strips are mutually spaced apart less than the width Ws of a single LED strip. In FIGS. 3D and 3E the width W is about two times Ws, and in FIG. 3C the width W is about four times Ws. In FIGS. 3B-C the elongated lighting module has a height H which is 4 respectively 5 times the height Hs of the LED strip.

Figure 4A:
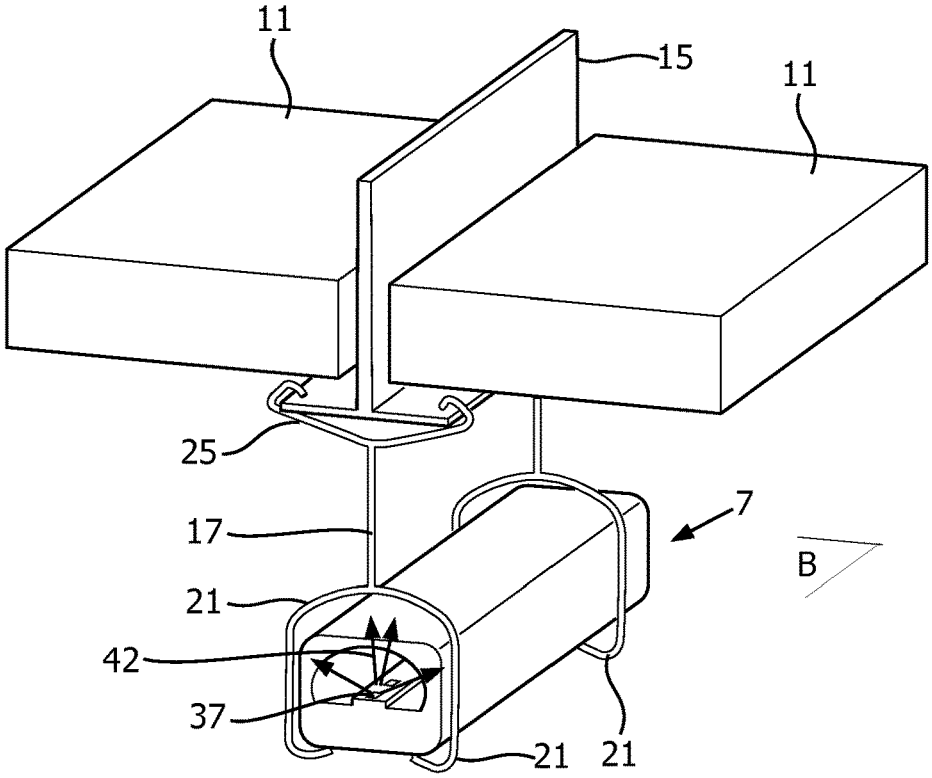
FIG. 4A-B show two embodiments for a suspension element in an installed configuration of the elongated lighting module to a ceiling.
Figure 4B:
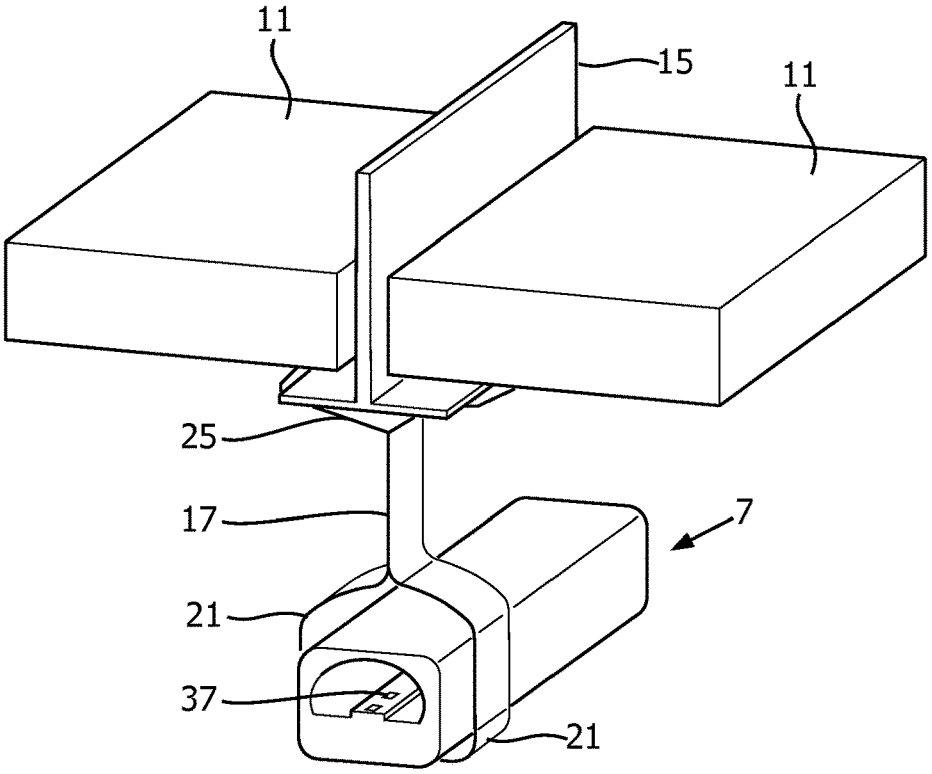

FIG. 4A-B show two embodiments of a suspension element 17 in an installed configuration of the elongated lighting module 7 to a ceiling. The ceiling comprises a grid of T-bars 15 that support ceiling tiles 11. The elongated lighting module 7 is suspended from the ceiling via a suspension element 17 that clamps with its second connector 25 around the T-bar. The first connector 21 of the suspension element clamps around the cross-section of the whole elongated lighting module. In FIG. 4A the first connector is embodied as a wire or cord, in FIG. 4B the first connector is embodied as a light transmissive, rigid strip, made from light transmissive material, in the figure from Poly-Carbonate. As shown, the plurality of LEDs 37 point toward the ceiling. Indicated in FIG. 4A is that the lighting module in operation issues only upwardly directed light rays 42, i.e. into an area between plane B and the ceiling, said plane B extending parallel to the ceiling tiles 11. Both embodiments are configured to counteract the occurrence of disturbing contrast and shadowing of the provided light. In these embodiments the elongated lighting module, for example, has strengthened corners of the housing as specific mounting element features.

Figure 5A:
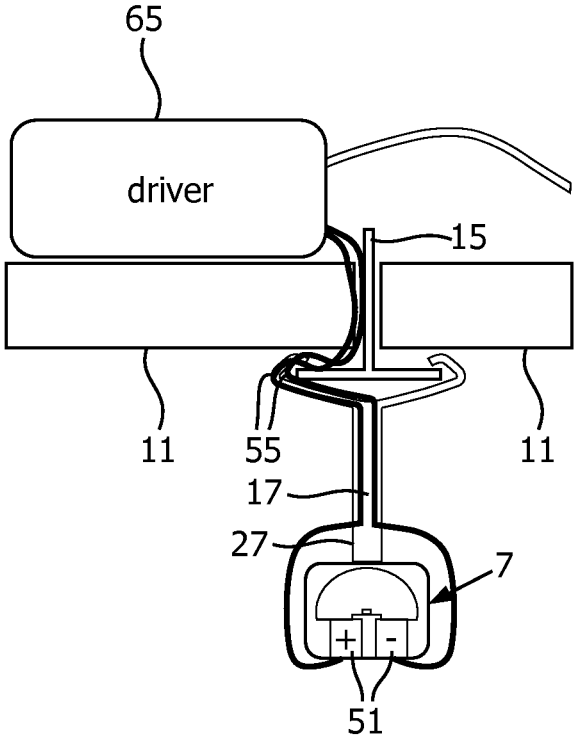
FIG. 5A-D shows a cross-sectional view of various embodiments for electrical connection and add-ons of the elongated lighting module.
Figure 5B:
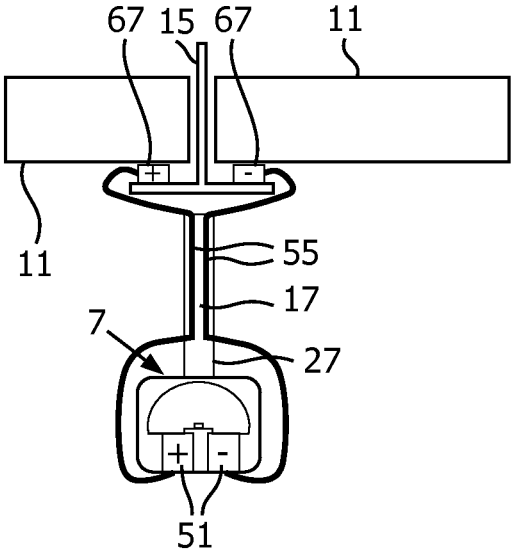
Figure 5C:
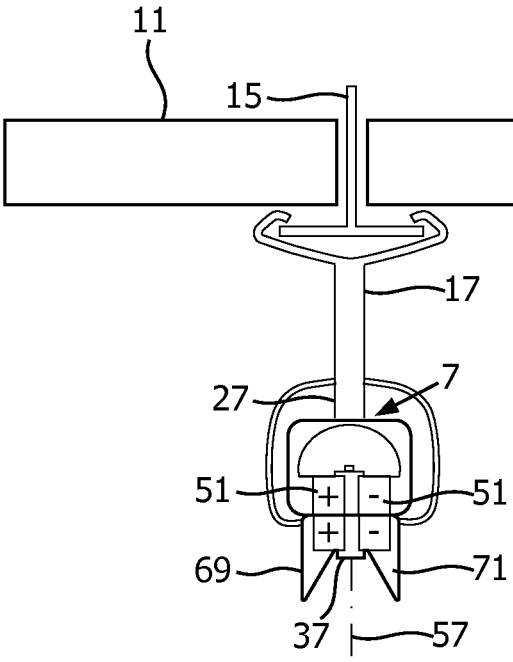
Figure 5D:
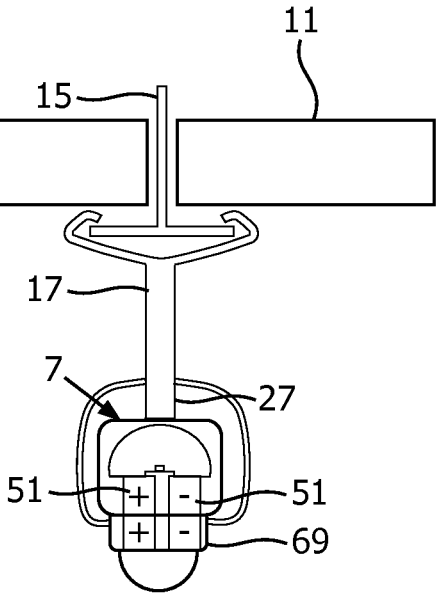

FIG. 5A-D shows a cross-sectional view of various embodiments for electrical connection and add-ons of the elongated lighting module 7 as suspended from the T-bars 15 of the ceiling. In FIG. 5A electrical cables 55 contact the elongated lighting module via bottom contacts 51 with a driver 65 located on a ceiling tile 11 of the ceiling, said electrical cables extend alongside the suspension element 17. In FIG. 5B, said cables 55 do not extend alongside the suspension element 17 but are passed internally through the suspension element, which thereto is embodied as a hollow tube, and emerge only at the mounting element 27 extending from the transparent cover, rendering the electrical connection to be unobtrusive and more aesthetically attractive. In FIG. 5B the T-bars are provided with electrically conductive strips 67 that are connected to a (low voltage) power supply (not shown). The embodiments shown in FIG. 5C-D have a similar construction as the embodiment shown in FIG. 5B, yet with the addition of various add-ons 69 for providing an additional functionality to the elongated lighting module and/or lighting system. Said add-ons 69 are electrically connected via the bottom contacts 51 of the elongated lighting modules and mechanically connected thereto via, for example magnets. In FIG. 5C the add-on is a plurality of LEDs 37 embodied as a LED-strip with a collimator 71, the LEDs have a beam axis 57 pointing downward away from the ceiling for providing direct, spot light. Alternatively this electrical connection can be attained only at the couple elements, in which case the LED add-on can function as emergency lighting. In FIG. 5D the add-on 69 is a sensor, for example an occupation sensor, an infrared sensor, a daylight sensor, a movement sensor, or a smoke sensor which points downward away from the ceiling. In these embodiments the electrical contacts are part of the mounting element.

Figure 6A:
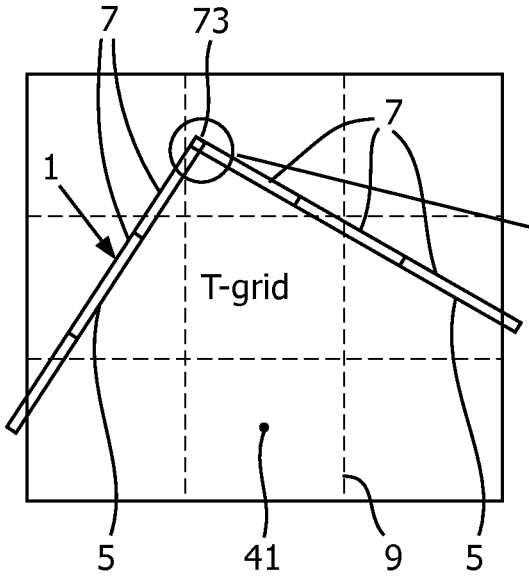
FIG. 6A-B shows a bottom view of an installed lighting system according to the invention and detail thereof.
Figure 6B:
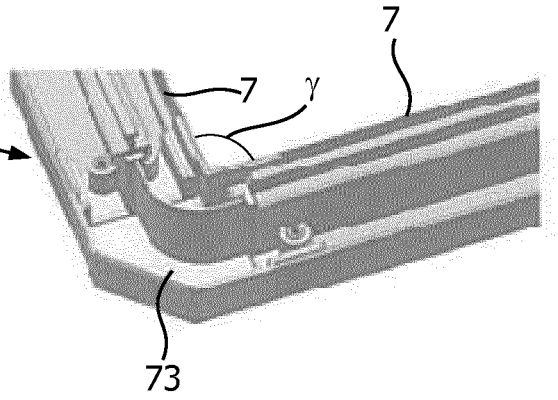

FIG. 6A-B shows a bottom view of an installed lighting system 1 according to the invention and detail thereof. In FIG. 6A the lighting system 1 comprises two rows 5 of a plurality of end-to-end coupled elongated lighting modules 7 that are suspended from the ceiling grid structure 9. The two rows are mutually end-to-end coupled by a curved couple element 73, which is shown in detail in FIG. 6B. The curved couple element 73 shown in FIG. 6B connects two elongated lighting modules 7 at a mutual connection γ angle of 90°, but it is apparent that curved couple elements can connect at other angles γ, for example curved couple elements having curvatures of 20°, 30°, 45°, 60°, 75°, 120° or 150° are possible. As shown in FIG. 6A, viewed along the suspension direction 41 or Z-direction in a Cartesian system, in the X-Y-plane (or plane P) the orientation of the rows lighting system is not bound to be aligned with the ceiling grid structure but are freely positionable with respect to said ceiling grid structure which is enabled by the rotation features of suspension element and its slideability over both the grid and the mounting element. Said free positioning of the lighting system is advantageous as it gives more design freedom and better tuning possibilities for desired lighting settings.

Figure 7A:
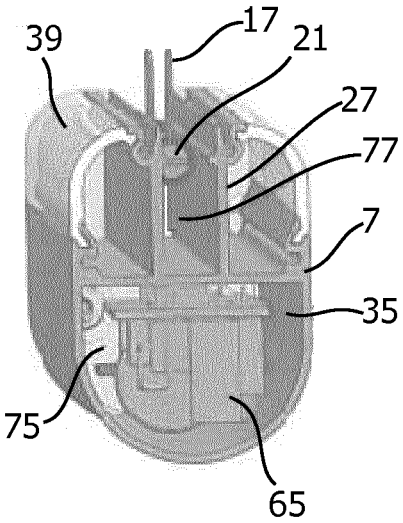
FIG. 7A-B show a cross-section and a worked-open side view of yet another embodiment of an elongated lighting module according to the invention.
Figure 7B:
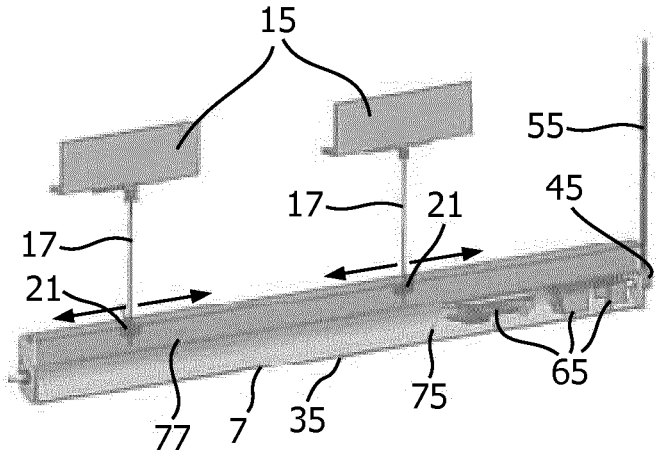

FIG. 7A and FIG. 7-B respectively shows a cross-section and a worked-open side view of yet another embodiment of an elongated lighting module 7 according to the invention. The elongated lighting module being suspended from T-bars 15 and is connected thereto via suspension elements 17 having a ball on a cord as a first connector 21 inserted in and continuously slideable in a cavity 77 of a U-shaped groove mounting element 27. The elongated lighting element comprises a housing 35 comprises a compartment 75 below optical elements/cover 39 and the light source (i.e. plurality of LEDs, not shown). In said compartment electronics like ballast, sensors and driver 65 for controlled operation of the light source are accommodated. The elongated lighting module being electrically connected at their housing end 45 via electrical cable 55 (only shown for one end).

The invention claimed is:

1. An elongated lighting module defining a longitudinal axis and comprising:

a housing having a base at a base side and a light transmissive cover comprising a light transmissive cover top at a top side opposite said base side and a light transmissive wall extending between the top side and the base side, an array of LEDs accommodated in a space enclosed by the base and the cover and facing away from the base side, a mounting element for suspended connection via a suspension element to a ceiling defining in suspended arrangement a suspension axis, the mounting element extending over essentially the full length of the module, centrally intersecting or extending on the cover top and enabling the suspension element to be displaceable along the longitudinal axis, and the transparent cover extending over essentially the whole width of the housing and portions of side walls of the housing either as one cover and the mounting element includes a clamp around the cross-section of the whole elongated lighting module or wherein the cover is divided by the mounting element into two elongated cover parts axially extending mutually parallel and next to each other.

2. An elongated lighting module as claimed in claim 1 comprising a suspension element, which comprises:

at a first end a first connector connected at the top side to the mounting element, and at a second, opposite end a second connector for connection to a ceiling, in a suspended arrangement the suspension axis is defined by the direction between the first and the second connector.

3. An elongated lighting module as claimed in claim 1, wherein the base has a base surface defining a plane B, the lighting device in operation issuing only light towards the cover, which is issued from the lighting device in an area between said plane B and the outer cover top surface.

4. An elongated lighting module as claimed in claim 1, wherein the plurality of LEDS are mounted on the mounting element, preferably at an angle β with the suspension axis toward the ceiling, wherein $0° <= \beta <= 90°$.

5. An elongated lighting module as claimed in claim 1, wherein in suspended arrangement the LEDs are equidistant or closer to the ceiling than the mounting element.

6. An elongated lighting module as claimed in claim 1, wherein the suspension element is adjustable in length.

7. An elongated lighting module as claimed in claim 1, wherein in a direction transverse to the longitudinal axis the mounting element has a U-shaped, T-shaped, Y-shaped, or cross-shaped cross section.

8. An elongated lighting module defining a longitudinal axis and comprising:

a housing having a base at a base side and a light transmissive cover comprising a light transmissive cover top at a top side opposite said base side and a light transmissive wall extending between the top side and the base side, an array of LEDs accommodated in a space enclosed by the base and the cover and facing away from the base side, a mounting element for suspended connection via a suspension element to a ceiling defining in suspended arrangement a suspension axis, the mounting element extending over essentially the full length of the module, centrally intersecting or extending on the cover top and enabling the suspension element to be displaceable along the longitudinal axis, and the transparent cover extending over essentially the whole width of the housing and portions of side walls of the housing, wherein the mounting element comprises electrical contact for electrical connection to the suspension element comprising an electric cable.

9. An elongated lighting module as claimed in claim 1, wherein the plurality of LEDs is a LED strip having a width Ws and the elongated lighting module has a width W which is in the range of 1.2 to 4 times the width of the LED strip.

10. An elongated lighting module as claimed in claim 1, wherein the plurality of LEDs comprises two LED strips which extend mutually parallel along the longitudinal axis and are mutually spaced apart by at the most the width of a single LED strip.

11. An elongated lighting module as claimed in claim 1, wherein the plurality of LEDs is a LED strip having a height Hs and the elongated lighting module has a height H which is in the range of 3 to 6 times the height of the LED strip.

12. An elongated lighting module as claimed in claim 1, wherein the lighting module is an indirect lighting module.

13. A lighting system comprising at least two mutually end-to-end coupled elongated lighting modules as claimed in claim 1, wherein the at least two elongated, indirect lighting modules are mutually coupled via a connection module.

14. A lighting system as claimed in claim 13, wherein the connection module comprises an additional device of at least one of a sensor, a light source, an alarming device (flashlight, sound horn), and a sprinkler head.

15. An elongated lighting module as claimed in claim 1, wherein the clamp around the cross-section of the whole elongated lighting module is either a wire, a cord or a light transmissive rigid strip.

* * * * *